US006136117A

United States Patent [19]

Shibata et al.

[11] Patent Number: 6,136,117

[45] Date of Patent: Oct. 24, 2000

[54] BOILER TUBE PROTECTOR AND A METHOD FOR ATTACHING SUCH PROTECTOR TO A BOILER TUBE

[75] Inventors: Toshio Shibata; Shigeo Ito, both of Kani-gun; Kazuhiro Mizuno, Mizunami; Yasuhiro Terashima, Yokohama; Yuji Nakagawa, Yokohama; Keita Inoue, Yokohama; Norihiko Orita, Yokohama; Tetsuo Takahashi, Yokohama; Kazuo Yamamura, Yokohama, all of Japan

[73] Assignee: NGK Insulators, Ltd. and Mitsubishi Heavy Industries, Ltd., Japan

[21] Appl. No.: 09/296,489

[22] Filed: Apr. 22, 1999

Related U.S. Application Data

[62] Division of application No. 08/987,422, Dec. 9, 1997.

[30] Foreign Application Priority Data

Dec. 12, 1996 [JP] Japan ..... 8-331887

[51] Int. Cl.[7] ..... F22G 3/00; F16L 9/00

[52] U.S. Cl. ..... 156/71; 156/89.11; 156/304.5; 156/155; 156/297; 29/890.03; 29/890.031

[58] Field of Search ..... 156/71, 89.11, 156/304.5, 293, 325, 155, 297; 29/890.03, 890.031, 890.051

[56] References Cited

U.S. PATENT DOCUMENTS

| | | | |
|---|---|---|---|
| 1,955,700 | 4/1934 | Snow | 122/6 |
| 2,435,362 | 2/1948 | Morton . | |
| 3,486,533 | 12/1969 | Doherty et al. . | |
| 3,572,662 | 3/1971 | Weaver . | |
| 3,881,864 | 5/1975 | Nicol . | |
| 3,914,100 | 10/1975 | Guskea . | |
| 4,140,484 | 2/1979 | Payne . | |
| 4,228,826 | 10/1980 | Campbell, Jr. . | |
| 4,275,771 | 6/1981 | Campbell, Jr. . | |
| 4,304,267 | 12/1981 | Campbell, Jr. . | |
| 4,337,034 | 6/1982 | Morgan, II et al. . | |
| 4,383,822 | 5/1983 | Schatschneider . | |
| 4,550,777 | 11/1985 | Fournier et al. . | |
| 4,682,568 | 7/1987 | Green et al. . | |
| 4,944,254 | 7/1990 | Fournier et al. . | |
| 5,154,648 | 10/1992 | Buckshaw . | |
| 5,220,957 | 6/1993 | Hance . | |
| 5,404,941 | 4/1995 | Jacksits . | |
| 5,411,080 | 5/1995 | Gentry . | |
| 5,511,609 | 4/1996 | Tyler . | |
| 5,724,923 | 3/1998 | Green . | |

FOREIGN PATENT DOCUMENTS

| | | |
|---|---|---|
| 14896/70 | 11/1971 | Australia . |
| 0 010 385 | 4/1980 | European Pat. Off. . |
| 0 272 579 A2 | 6/1988 | European Pat. Off. . |
| 38 23 439 A1 | 1/1990 | Germany . |
| 7-239104 | 9/1995 | Japan . |
| 278811 | 10/1927 | United Kingdom . |
| WO 96/36835 | 11/1996 | WIPO . |

*Primary Examiner*—Sam Chuan Yao
*Attorney, Agent, or Firm*—Parkhurst & Wendel, L.L.P.

[57] ABSTRACT

A method of attaching a boiler tube protectors having a cylindrical or semi-cylindrical shape around an outer peripheral face of a boiler tube with mortar, which boiler tube protectors, are a plurality of ceramic bodies closely arranged along their parting planes, wherein the parting planes includes means for restraining slippage of each of the ceramic bodies along the parting planes.

3 Claims, 8 Drawing Sheets

BOILER TUBE PROTECTOR AND A METHOD FOR ATTACHING SUCH PROTECTOR TO A BOILER TUBE

This is a Division of application Ser. No. 08/987,422 filed Dec. 9, 1997.

BACKGROUND OF THE INVENTION

1. Field of the Invention

The present invention relates to a boiler tube protector and a method for attaching such a protector to a boiler tube.

2. Related Art Statement

In boiler tubes T of a refuse incinerator type boiler as shown in FIG. 6, their heat-conductive performance is deteriorated with a large amount of soot attached to the tubes. For this reason, it is a conventional technique that a soot blower generally outlined in FIG. 7 is intermittently advanced among the boiler tubes T, and the soot on the surfaces of the boiler tubes T is removed by ejecting steam through the soot blower. However, this causes a problem that portions of the boiler tubes T upon which steam is directly blown through the soot blower are likely to be thinned through being attacked with drain, steam, ash erosion, etc.

Under the circumstances, as shown in FIG. 8, a protector made of low carbon steel or stainless steel is attached to that surface portion of the boiler tube T near which the soot blower is moved so that the tube may be prevented from being thinned. However, since such protectors are readily corroded with corrosive gases contained in exhaust gases, there is a problem that the protectors have durability of less than one year only, and at the worst the protectors are corroded out in three months.

SUMMARY OF THE INVENTION

The present invention is to provide a boiler tube protector and a method for attaching such a protector to a boiler tube, which can solve the conventional problems mentioned above, can assuredly prevent the boiler tube from being thinned in soot blowing, and afford good durability and workability.

The boiler tube protector according to the present invention, which has been accomplished to solve the above-mentioned object, has a cylindrical or semi-cylindrical shape and is adapted to be attached around an outer peripheral face of a boiler tube with mortar, said boiler tube protector comprising a plurality of ceramic bodies closely arranged along their parting planes, wherein the parting planes comprise means for restraining slippage of each of the ceramic bodies along the parting planes. The ceramic bodies of the boiler tube protector are divided laterally or peripherally, and their parting planes extend substantially vertically. The slippage-restraining means may include a stepped engagement a wavy engagement, a zigzag engagement, a projection-recess engagement, etc. The parting planes of the ceramic bodies may be inclined or parallel to a flat plane containing a central axis of the cylindrical or semi-cylindrical boiler tube protector, when assembled around the boiler tube in the form of the protector. The parting plane of each ceramic body at each of both sides thereof may comprise a stepped portion for restraining slippage of each ceramic body along the parting plane. In the boiler tube protector, the stepped portion preferably forms such an acute angle with respect to the parting plane of each ceramic body that movement of the ceramic body in a direction orthogonal to said parting plane may be restrained.

The method for attaching the above cylindrical or semi-cylindrical boiler tube protectors around the outer peripheral face of the boiler tube extending in a vertical direction at a plurality of stages by using mortar, which method provides a stopper at a lower end of a lowermost stage, arranging the boiler tube at plural stages protectors around the outer peripheral face of the boiler tube while interposing motar between the outer peripheral face of the boiler tube and the boiler tube protector and tentatively stopping the boiler tube protectors by means of the stopper, and curing the mortar with heat generated during operating the boiler. In the attaching method, the stopper is preferably removed with the heat generated during operating the boiler. Further, the stopper is also preferably made of an inflammable material or a metal which can be melted away by the heat generated during operating the boiler.

Since the boiler tube protector according to the present invention is constituted by combining the ceramic bodies, the protector has excellent durability and can assuredly prevent the boiler tube from being thinned in soot blowing. Further, since the boiler tube protector needs not be welded unlike the conventional protectors, and since the parting plane of each ceramic body at each of both sides thereof is provided with a stepped portion for restraining slippage of each ceramic body along the parting plane, constructing workability of the boiler tube protector around the boiler tube is excellent and the boiler tube protector can be easily attached around the outer peripheral face of the boiler tube. In addition, according to the invention method for attaching the boiler tube protectors around the outer peripheral face of the boiler tube at plural stages, the boiler tube protectors can be easily attached to even the boiler tube extending in a vertical direction by utilizing the stopper.

These and other objects, features and advantages of the invention will be easily appreciated upon the reading of the following description of the invention when taken in conjunction with the attached drawings, with the understanding that some modifications, variations and changes of the same could be easily made.

BRIEF DESCRIPTION OF THE DRAWINGS

For a better understanding of the invention, reference is made to the attached drawings, wherein.

DETAILED DESCRIPTION OF THE INVENTION

The boiler tube protector according to the present invention is comprised of a ceramic material having excellent corrosion resistance. However, in order to minimize reduction in heat conductivity of that portion of the boiler tube at which the boiler tube protector is attached, it is preferable to select a ceramic material having excellent heat conductivity. As such a ceramic material having both corrosion resistance and heat conductivity, SiC may be recited by way of example. As mortar to attach the boiler tube protector to the outer peripheral face of the boiler tube, SiC based mortar, mullite based mortar, alumina based mortar or the like may be used. For the same reason as stated above, it is preferable to select SiC based mortar. Ceramic fibers may be used instead of a part or an entire part of the ceramic material. The ceramic fibers may be used in a mixed state with mortar, or appropriate ceramic fiber-based mortar may be used for this purpose. The term "mortar" used in the claims includes mortar itself and the above ceramic fibers.

PREFERRED EMBODIMENTS OF THE PRESENT INVENTION

In the following, preferred embodiments of the present invention will be described.

Figure 1A:
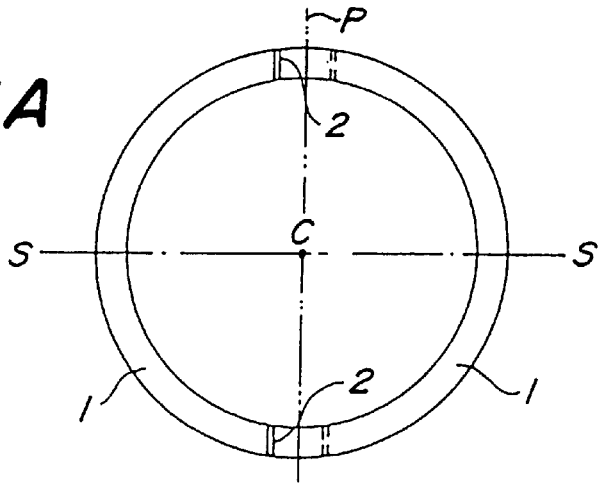
FIGS. 1(A) and 1(B) are a plane view and a front view of a first embodiment of the present invention, respectively.
Figure 1B:
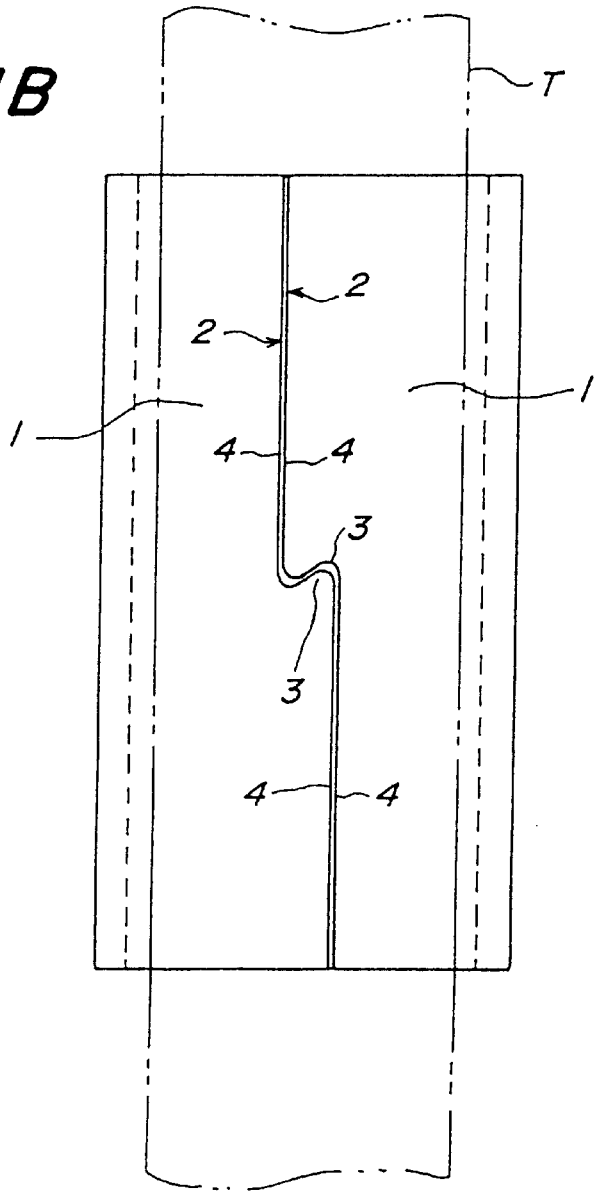

FIGS. 1(A) and 1(B) are view illustrating a first embodiment of the boiler tube protector according to the present invention. The boiler tube protector has a cylindrical shape, and is constituted by two ceramic bodies closely fitted to each other along their parting planes. Each of the parting planes is vertically provided at a side of the ceramic body 1, and comprises a stepped portion 3 extending obliquely in a middle portion of the parting plane 2 and vertical planes extending vertically from opposite ends of the stepped portion 3 and in parallel to an imaginary plane P passing the axis C of the boiler tube. The ceramic bodies are attached to the boiler tube via mortar. Each ceramic body is symmetric to each other via a plane S passing the axis of the boiler tube protector 1. These ceramic bodies are produced by casing SiC, and have the inner diameter slightly larger than the outer diameter of the boiler tube T. The ceramic bodies are not limited to such two-split ones, and they are three or more-split ceramic bodies may be used.

As mentioned above, a stepped portion 3 is formed at each of the parting planes 2 of the each ceramic body 1 extending substantially axially at either side. This stepped portion 3 functions to restrain relative slippage between the ceramic bodies 1 along with their parting planes 2 so that even if the mortar fixing one of the ceramic bodies 1 is cracked during the operation of the boiler, the other ceramic body 1 may not drop. Particularly in this embodiment, the stepped portion 3 forms an acute angle relative to the vertical portions of the parting plane 2, so that even if the ceramic bodies are tried to be spaced from each other in a direction orthogonal to the parting plane 2, the inclined stepped portions are hooked to each other to prevent separation thereof. Therefore, peeling down of the ceramic bodies can be assuredly prevented.

Figure 2A:
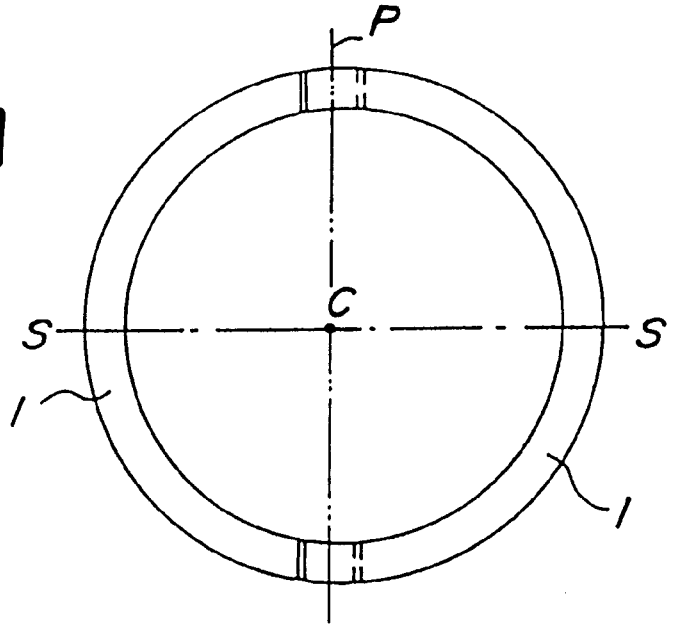
FIGS. 2(A) and 2(B) are a plane view and a front view of a second embodiment of the present invention, respectively.
Figure 2B:
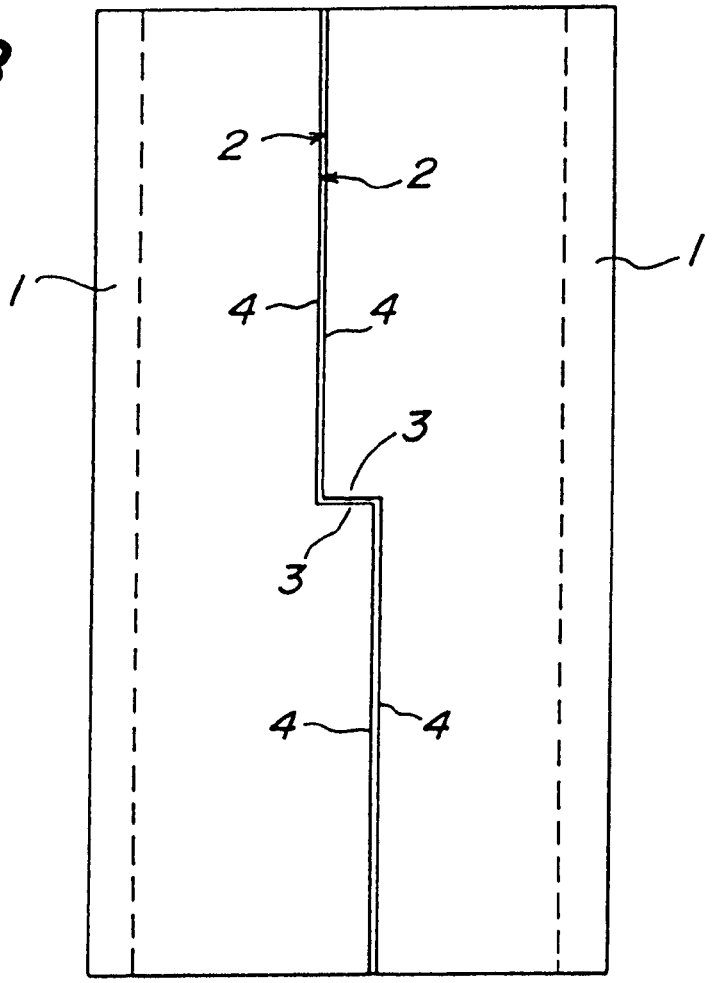
Figure 3A:
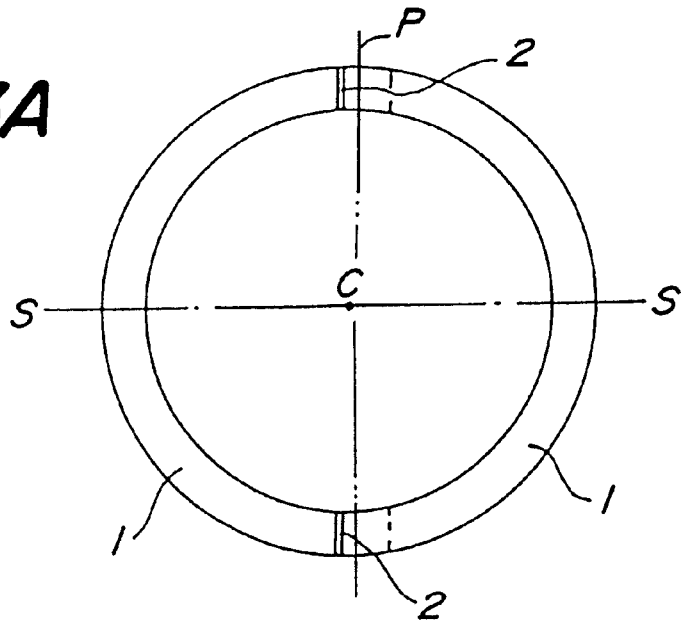
FIGS. 3(A) and 3(B) are a plane view and a front view of a second embodiment of the present invention, respectively.
Figure 3B:
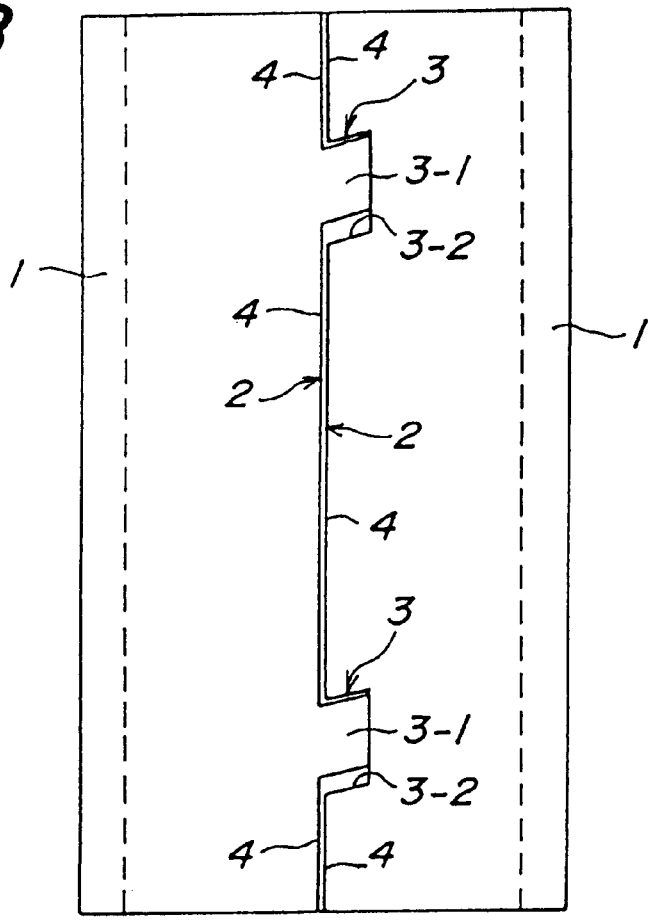

On the other hand, in a second embodiment shown in FIG. 2, a stepped portion 3 extends in a direction orthogonal to a parting plane 2 so that the stepped portion 3 may merely function to restrain relative slippage between the ceramic bodies 1 along their parting planes 2. Further, in a third embodiment shown in FIG. 3, stepped portions are formed at a parting plane of a ceramic body at two, upper and lower, stages. Each of the stepped portions consists of a projection 3-1 projecting from one of the ceramic bodies, and the other is provided with a recess 3-2 to which the projection 3-1 is to be fitted when the ceramic bodies are close fitted to each other around the boiler tube T. As is clear, the number and the shape of the stepped portion(s) 3 may be changed in various ways. In each of the above embodiments, however, the stepped portion or stepped portions 3 are formed not in an axis symmetry but in plane symmetry with respect to a plane S—S.

Figure 4:
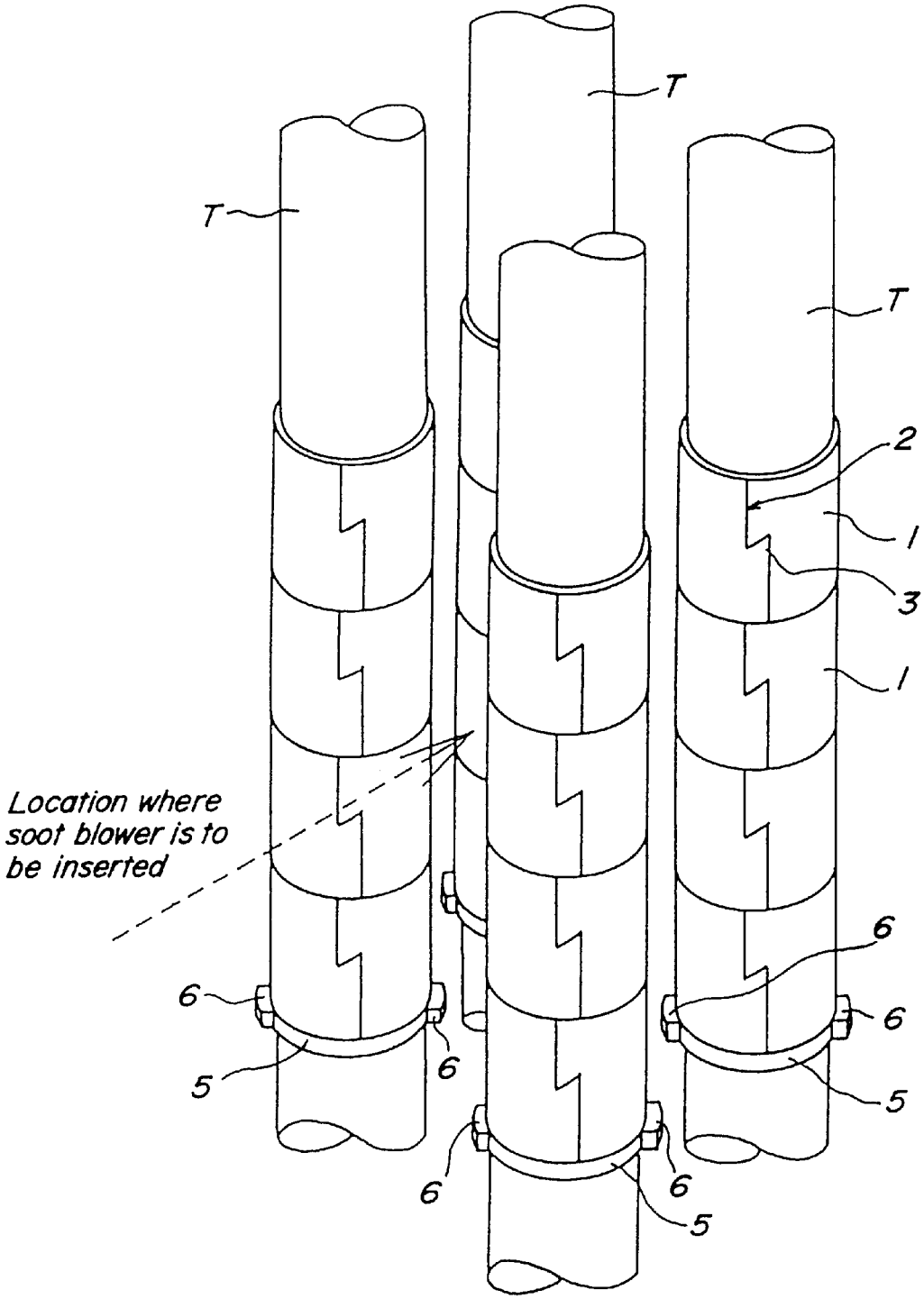
FIG. 4 is a perspective view for illustrating the state in which boiler tube protectors are attached around boiler tubes.
Figure 5A:
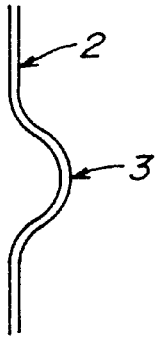
FIGS. 5A through 5F illustrate ceramic bodies having various parting planes of such as wavy, zigzag shapes, etc.
Figure 5B:
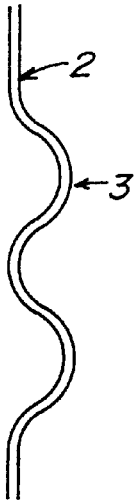
Figure 5C:
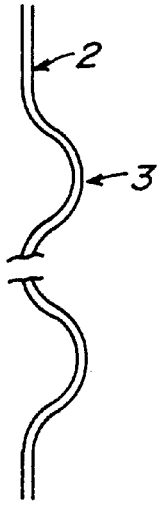
Figure 5D:
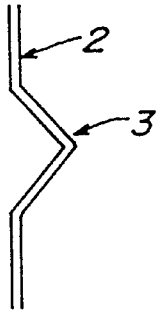
Figure 5E:
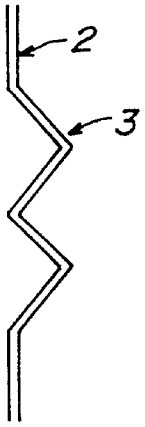
Figure 5F:
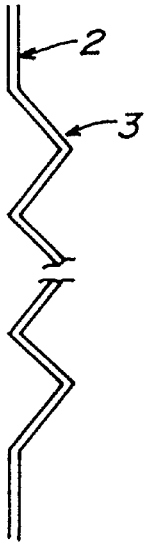
Figure 6:
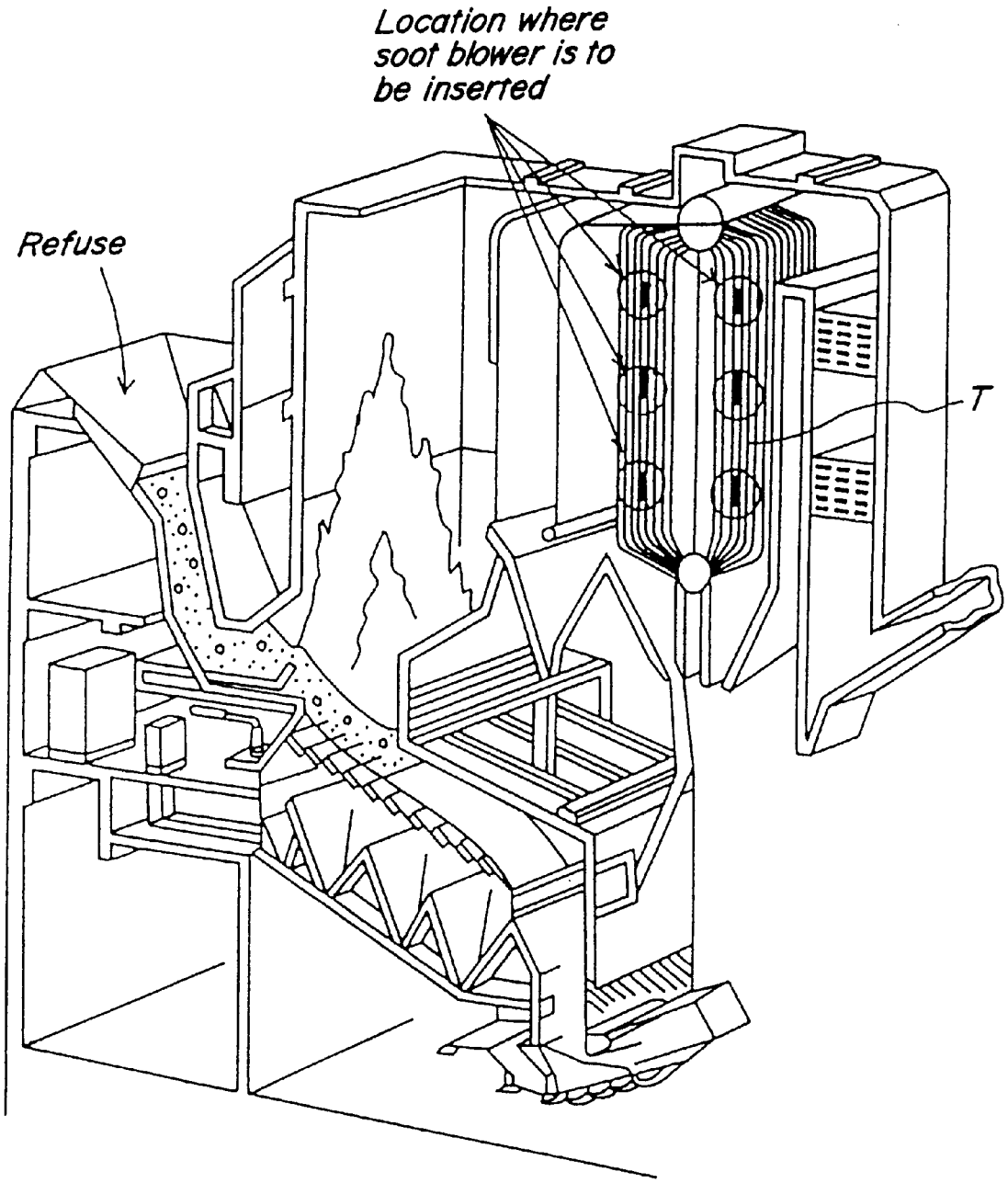
FIG 6 PRIOR ART
FIG. 6 is a perspective view of a refuge incinerator type boiler.
Figure 7:
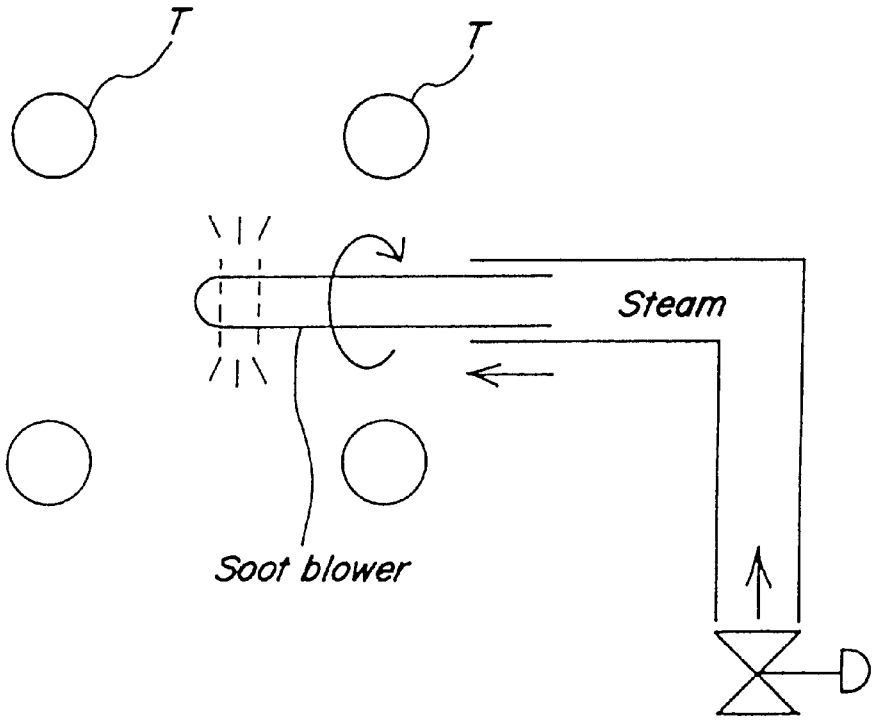
FIG 7 PRIOR ART
FIG. 7 is a plane view for illustrating a soot blower in concept.
Figure 8:
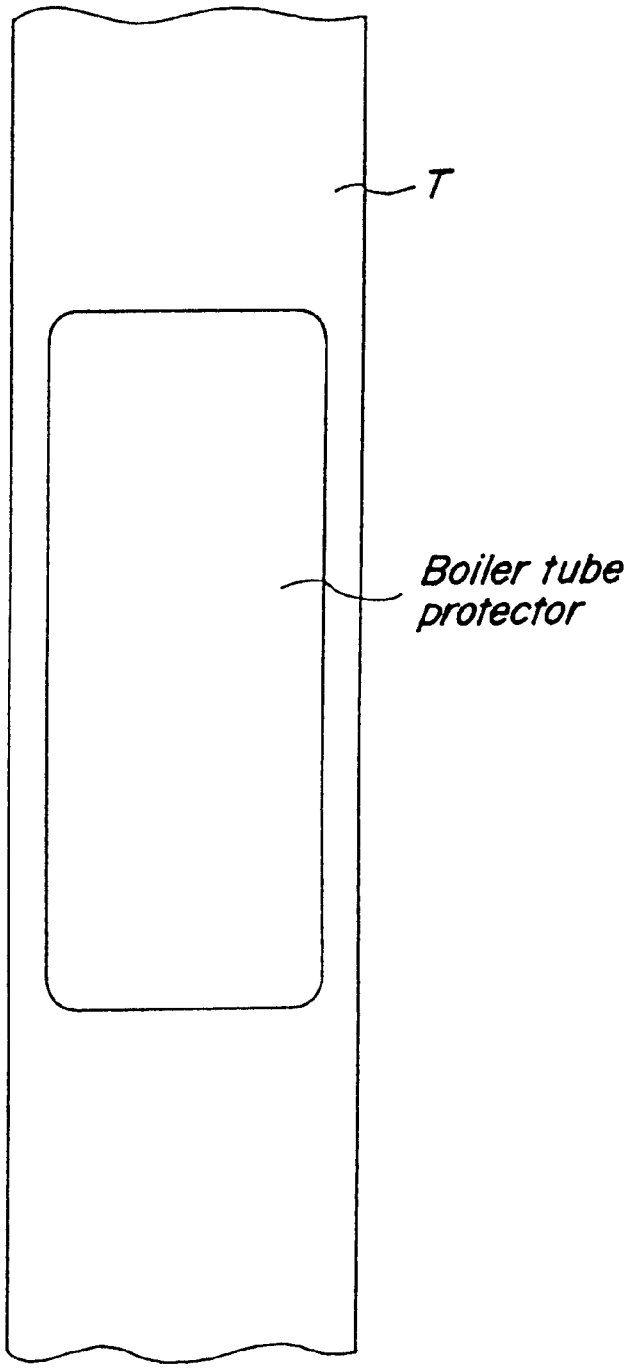
FIG 8 PRIOR ART
FIG. 8 is a front view of a conventional boiler tube protector.

As shown in FIG. 4, the ceramic bodies 1 as constructed above are attached to outer peripheral faces of boiler tubes T at plural stages by means of mortar near a place where a soot blower is to be located and moved. The boiler tube T is partially wrapped with the boiler tube protector by attaching two ceramic bodies 1 to the boiler tube T from opposite sides thereof such that their parting planes 2 and stepped portions 3 are closely fitted together, while mortar is applied to the inner side of each of the ceramic bodies. At that time, since two ceramic bodies 1 can be appropriately attached around the boiler tube T merely by slightly adjusting them in a longitudinal direction of the boiler tube T, the ceramic bodies can be easily attached to the boiler tube even at a location where no excess space is present. Since the temperature of the boiler tube T rises to around 200° C. in the case that the surrounding temperature is 650° C., large temperature difference occurs between the inner and outer surfaces of the ceramic body 1. The mortar has function to mitigate thermal shock borne by the ceramic body 1.

In order to sufficiently protect the boiler tube T from the soot blower, it is preferable that the boiler tube protectors are attached to the boiler tube over a length of around 1 meter around the soot blower as a center. However, it is not necessarily easy to integrally mold a ceramic body 1 having such a long length. In each of the above embodiments, the length of each ceramic body is ordinarily around 200 mm. Therefore, in such a case, the ceramic bodies 1 are attached around the boiler tube T at five stages. In a case where the boiler tube T is extended in a vertical direction as shown in FIG. 4, it is feared that the ceramic bodies may slip down before the mortar is cured.

Thus, as shown in FIG. 4, a stopper 5 provided at a lower end of the lowermost stage for the boiler tube protectors, and the boiler tube protectors can be temporarily stopped around the boiler tube by means of the stopper 5. In order to prevent the non-cured mortar from flowing down, it is preferable to use a ring-shaped stopper 5 as shown. A material constituting the stopper 5 is not particularly limited. For example, the stopper may be made of a mortar or ceramic ring having excellent heat resistance. However, the stopper 5 is more preferably made of an inflammable material or a metal which is melted away with heat generated in the operation of the boiler. Since it is not feared that the ceramic bodies peel down by their self-weight after the mortar is cured, the stopper 5 need not be retained around the boiler tube T. Further, the possibility that the remaining stopper 5 may afford an adverse effect upon the performance of the boiler can be removed. If the boiler is operated in the state that the boiler tube protectors are temporarily fixed around the boiler tubes T by using the stoppers 5, the mortar is cured by the heat on operation of the boiler, which can assuredly attach the boiler tube protectors around the boiler tubes. In FIG. 4, a reference numeral 6 is a fixture bolt for fastening two rings of the stopper 5.

The boiler tube protector according to the present invention attached around the boiler tube T effects to protect the boiler tube from steam ejected through the soot blower and to prevent the boiler tube T from being thinned. In addition, since the boiler tube protector according to the present invention is constituted by combining split ceramic bodies 1, the protector will not be corroded with a corrosive gas unlike conventional metallic protectors, and therefore can exhibit excellent durability.

What is claimed is:

1. A method for attaching boiler tube protectors around an outer face of a vertical boiler tube, comprising the steps of:

applying mortar on an outer face of a vertical boiler tube;

arranging a plurality of boiler tube protectors in stages around the outer face of the vertical boiler tube and in contact with the mortar on said tube, wherein a stage comprises boiler tube protectors of complementary shape vis-a-vis each other and including means for restraining slippage of adjacent protectors along parting planes between such protectors; and, providing a stopper around the lower end of the lowermost of said stages for maintaining the protectors of the lowermost stage in position on the boiler tube for limiting flow of said mortar, wherein the stopper is heat degradable and removed by heat generated during operation of the boiler tube.

2. The method set forth in claim 1, wherein the mortar is cured with heat generated during boiler operation.

3. The method set forth in claim 1, wherein the stopper comprises inflammable material or metal.

* * * * *